US012552571B2

(12) United States Patent
Heston

(10) Patent No.: US 12,552,571 B2
(45) Date of Patent: Feb. 17, 2026

(54) FILM FREE END CONTROL APPARATUS AND METHOD FOR A STRETCH WRAPPING MACHINE

(71) Applicant: Top Tier, LLC, Clackamas, OR (US)

(72) Inventor: Stephen L. Heston, Clackamas, OR (US)

( * ) Notice: Subject to any disclaimer, the term of this patent is extended or adjusted under 35 U.S.C. 154(b) by 324 days.

(21) Appl. No.: 18/294,062

(22) PCT Filed: Dec. 3, 2020

(86) PCT No.: PCT/US2020/063101
§ 371 (c)(1),
(2) Date: Jan. 31, 2024

(87) PCT Pub. No.: WO2022/119573
PCT Pub. Date: Jun. 9, 2022

(65) Prior Publication Data
US 2024/0199262 A1 Jun. 20, 2024

(51) Int. Cl.
*B65B 57/04* (2006.01)
*B65B 11/04* (2006.01)
(Continued)

(52) U.S. Cl.
CPC ..... *B65B 57/04* (2013.01); *B65B 11/045* (2013.01); *B65B 41/12* (2013.01); *B65H 23/044* (2013.01); *B65H 23/1825* (2013.01); *B65H 26/025* (2013.01); *B65H 35/04* (2013.01); *B65B 2011/002* (2013.01);
(Continued)

(58) Field of Classification Search
CPC ..... B65B 11/045; B65B 2011/002; B65B 41/12; B65B 57/04; B65H 23/044; B65H 23/1825; B65H 2301/3251; B65H 2301/51539; B65H 2404/693; B65H 2405/50; B65H 2406/10; B65H 26/025;
(Continued)

(56) References Cited

U.S. PATENT DOCUMENTS 4,077,179 A * 3/1978 Lancaster ..... B65B 11/045 53/465
5,365,723 A * 11/1994 Ramos ..... B65B 11/045 53/74
(Continued)

OTHER PUBLICATIONS

International Search Report and Written Opinion, mailed Feb. 26, 2021, issued for International Patent Application No. PCT/US2020/063101, 14 pages.

*Primary Examiner* — Himchan Song
(74) *Attorney, Agent, or Firm* — Klarquist Sparkman, LLP

(57) ABSTRACT

An apparatus and method for stretch wrapping of a palletized load uses film tension feedback derived from a film tension control load cell to control film dispensation. The load cell measures film tension and the film payout rates is determined by the film tension. Film tension values are used to determine when an out of bounds condition occurs, namely, when a film break has occurred, or when a possible film break is about to occur or when the film has been cut at the end of a wrapping cycle. To prevent film free end entanglement caused by a break, clamps engage the film so the film tail is controlled, eliminating the risk of recoil. The broken film tail may then be quickly and reliably reattached to the rotating load in a desired position.

16 Claims, 10 Drawing Sheets

(51) Int. Cl.

| | |
|---|---|
| ***B65B 41/12*** | (2006.01) |
| ***B65H 23/04*** | (2006.01) |
| ***B65H 23/182*** | (2006.01) |
| ***B65H 26/02*** | (2006.01) |
| ***B65H 35/04*** | (2006.01) |
| *B65B 11/00* | (2006.01) |

(52) U.S. Cl.
CPC ..... *B65H 2301/51539* (2013.01); *B65H 2405/50* (2013.01); *B65H 2406/10* (2013.01); *B65H 2601/51* (2013.01); *B65H 2801/81* (2013.01)

(58) Field of Classification Search
CPC ..... B65H 2601/325; B65H 2601/51; B65H 2801/81; B65H 35/008; B65H 35/04
See application file for complete search history.

(56) References Cited

U.S. PATENT DOCUMENTS

| | | | | |
|---|---|---|---|---|
| 6,453,643 | B1 * | 9/2002 | Buscherini | B65B 11/025 53/399 |
| 6,516,591 | B1 * | 2/2003 | Lancaster, III | B65B 11/045 53/556 |
| 2011/0146203 | A1 * | 6/2011 | Lancaster, III | B65B 57/04 53/220 |
| 2015/0151861 | A1 * | 6/2015 | Chalmers | B65B 11/045 53/389.2 |
| 2018/0162568 | A1 * | 6/2018 | Pierson | B65B 41/12 |
| 2019/0177024 | A1 * | 6/2019 | Lancaster, III | B65B 11/025 |

* cited by examiner

FILM FREE END CONTROL APPARATUS AND METHOD FOR A STRETCH WRAPPING MACHINE

CROSS REFERENCE TO RELATED APPLICATIONS

This is the U.S. National Stage of International Application No. PCT/US2020/063101, filed Dec. 3, 2020, which was published in English under PCT Article 21 (2). The application is incorporated herein in its entirety.

TECHNICAL FIELD

The present invention relates to apparatus and methods for wrapping a load, and more specifically, a stretch wrapping machine for wrapping a palletized load of items with stretch wrapping material, in which the machine includes components for controlling a free film tail to prevent unintentional engagement of the film tail with components of the stretch wrapping machine.

BACKGROUND

Stretch wrapping is a commonly used method of protecting palletized loads of material for shipping. Described generally, stretch wrapping involves wrapping a specialized film around a stack of items such as cases that have been arranged on a pallet. The film is wrapped around the cases under tension and thereby stabilizes the stack to minimize the risk of damage during shipping. Tension can be provided by the memory recovery of pre-stretched film, and tension may also be created by resistance between the load and film dispenser or a combination of the two.

There are many styles and designs of automated or semi-automated stretch wrapping machines, many of which work in cooperation with automated palletizing machines that build the palletized loads. The stretch wrapping machines provide relative rotation between the palletized load and a dispenser that holds a roll of stretch wrapping film. Typically, either the pallet and load are stationary with the dispenser rotating around the load, or the pallet and load are rotated relative to a stationary dispenser. Either way, the stretch wrapping film is wrapped helically up and down the load under tension to stabilize it.

Stretch wrapping machines are used in highly automated production and packaging lines and must be able to keep up with throughput rates of the other equipment used in the palletizing operation so that the stretch wrapping operation does not slow the overall production. As such, the devices often operate at relatively high production rates themselves. But stretch wrapping is not always a simple operation. For example, it is known that with a rectangular load on a pallet the demand for the stretch wrapping film varies as the corners of the load pass by the film dispensing point: the payout demand for film increases as the corner of the load passes the dispensing point and decreases as the film is being dispensed across the side of the load between corners. In addition to the payout rate, the amount of tension on the film has a direct impact on the stability of the load when completely wrapped. Many stretch wrapping machines use tensioning devices to control the tension on the film. However, tension forces vary with rotational position and as a result, proper tensioning is often difficult to maintain with high throughput rates. When the film breaks for any number of reasons (including excessive tension), the operation of the stretch wrapping device may be stopped or slowed while the film is reattached to the load, either automatically or with operator intervention.

U.S. Pat. No. 10,604,284, the entire disclosure of which is incorporated herein by this reference, describes a stretch wrapping apparatus that wraps a palletized load that is placed on a rotating turntable. A stretch wrapping head feeds pre-stretched wrapping film toward the rotating load and air jets blow the tail of the film onto the load. Relative rotational movement is created between the wrapping head and the load and the free end of the film is unsupported by any mechanical structure and is directed toward the load only with air from the jets. The free end of the film attaches to an outer surface the load and the wrapping head moves vertically so that the load is helically wrapped. Film is dispensed at a rate to provide payout of film that is consistent with the demand as each load corner transitions through its relative distance change from the dispensing point based on calculations intervals. A sensor detects changes in the optical character of the film—defects—to determine an out of bounds condition such as a film break.

A free film end, also referred to at times herein as a "film tail" is created in three different situations. First, when the free end of the film is being dispensed toward a load prior to attachment of the film tail to the load. Second, when a wrapping operation is complete and the film has been cut, and third, when a film break occurs during wrapping operations. In a stretch wrapping machine such as that described in U.S. Pat. No. 10,604,284, which blows the film tail toward the load, it has been found that positive control of the film tail is necessary to insure that the film tail does not become entangled with the stretch wrapping head. Thus, in any of the three conditions described above where a film tail is created, it is desirable to prevent the film from becoming entangled in the stretch wrapping machine. If entanglement occurs, wrapping operations are slowed and if the entanglement is serious enough, operator intervention may be required.

In the first situation described above, where the film tail is being dispensed toward the rotating load prior to engagement of the film to the load, positive control of the film tail retains the film in a desired position relative to the load so that the film will be blown toward the load for engagement as described in U.S. Pat. No. 10,604,284. In the second situation, that is, when a wrapping operation is complete and the film has been cut, positive control of the film prior to or concurrent with film cutting prevents film tail spring-back and the risk of entanglement from cutting the film under tension, and also retains the film in an ideal position for it to be blown toward the next load to be wrapped. The third situation, namely, when there is a break in the film during wrapping operations, presents the most serious risk of film entanglement with the stretch wrapping head. Because there is tension on the film as it is being wrapped, when a break occurs the film tail created by the break may recoil or snap back and thereby be entangled with the stretch wrapping head. The film tail may also be relatively long, sometimes between 20 and 40 inches depending on the equipment setup, and the film tail may drape downwardly under the force of gravity. This can cause a couple of problems. First, the draping tail may become entangled with other equipment. Second, a long, uncontrolled, and draping film tail may be difficult for the blower to engage for reattachment to the load. More problematically, when a film break occurs an uncontrolled film tail may become engaged with film that is already being dispensed through the pre-stretch rollers, causing the film tail to wrap up with the in pre-stretch roller system when it is powered up for the next blow out. This can quickly damage the pre-stretch roller system and can lead to downtime and expensive repairs.

Known stretch wrapping machines that do not use a blower to attach film to a load use a clamp that is mounted in a position that is fixed relative to the rotation device and the load, not in a position that is fixed relative to the stretch wrapping head. For instance, a turntable may have a clamp to control film and allow attachment of the film to the next load. Or in the case of a fixed load with a stretch wrapping head that rotates around the load, a fixed clamp adjacent to the stationary load is used to control film. Neither of these arrangements allow for control of film tail resulting from a film break, and do not contemplate or prevent entanglement of the film tail.

There is an ongoing need for improved stretch wrapping devices that balance the needs and challenges of keeping up with production rates while wrapping loads with proper film tension to correctly stabilize the loads. There is a further need for improved stretch wrapping apparatus that prevents the problems described above with respect to uncontrolled film tails in combination with the use of blown film as a method of load attachment that is achieved by blowing film towards (a) an already partially wrapped load with broken film tail managed to prevent entanglement until reattachment is accomplished with film blow, (b) to a load built without film with film tail managed and controlled between the prior film cut and film attachment to new load, (c) an un-started load where the film is blown onto an empty pallet prior to first layer deposit (where concurrent palletizing and wrapping is being done), or (d) film blown between an already positioned layer and the next layer deposit (for instance, where concurrent palletizing and wrapping is occurring). Blown film reattachment may be contrasted with current industry practice of a film tail clamp that is in a fixed position relative to the load while differential rotation occurs; with blown film as described herein, the tail clamp is in a fixed position relative to the film dispensing position rather than the load and thereby prevents entanglement caused by recoil.

The present invention comprises an improved apparatus and method for automated stretch wrapping of a palletized load. The apparatus utilizes a film tension feedback parameter derived from a film tension control load cell. The load cell continuously monitors and measures film tension during wrapping operations and based on the film tension and the film payout rate is determined by the film tension as measured by the load cell. The film is paid out in reaction to the film tension and film payout rate, or film speed, is adjusted in a reactionary manner during relative rotation; no proactive film speed calculations are performed. The tension values are monitored and used to determine when a film out of bounds condition occurs, namely, a film break has occurred, or when a possible film break is about to occur or when the film has been cut at the end of a wrapping cycle. When any of these out of bounds conditions occur, film clamps engage the film prior, concurrent with or slightly after the out of bounds conditions occur. Relative rotation of the load to film dispenser may continue, so if the out of bounds condition is a predicted film break, a controlled film break is accomplished. That is, with the clamps engaging the film, with film delivery stopped, and relative rotation between the dispenser and the load continuing, the film breaks downstream of the clamps in a relatively controlled manner, eliminating the risk of recoil and entanglement. The broken film tail may then be quickly and reliably reattached to the rotating load in a desired position. For example, the vertical position of the stretch wrapping head may be changed subsequent to the break so that the film tail is blown toward the load, and reattached to the load such that the film overwraps the broken, free end of the film that is on the load. When the stretch wrapping head is in the desired vertical position, the clamps are released, film blow is enabled and film delivery is resumed to continue wrapping automatically without interruption.

The sensitivity of the load cell thus allows for control of predictive film break (in addition to actual film break) and for reattachment when relative rotation continues with an increase in film dispensing rate to match relative rotation speed.

BRIEF DESCRIPTION OF THE DRAWINGS

The invention will be better understood and its numerous objects and advantages will be apparent by reference to the following detailed description of the invention when taken in conjunction with the following drawings.

in FIG. 1 the film clamps are shown in the clamped position and the film is securely gripped by the clamp arms.

DETAILED DESCRIPTION OF THE ILLUSTRATED EMBODIMENTS

The primary structural components of stretch wrapping apparatus 10 are described first with reference to the drawings. Operational characteristics and functions are then described.

Figure 1:
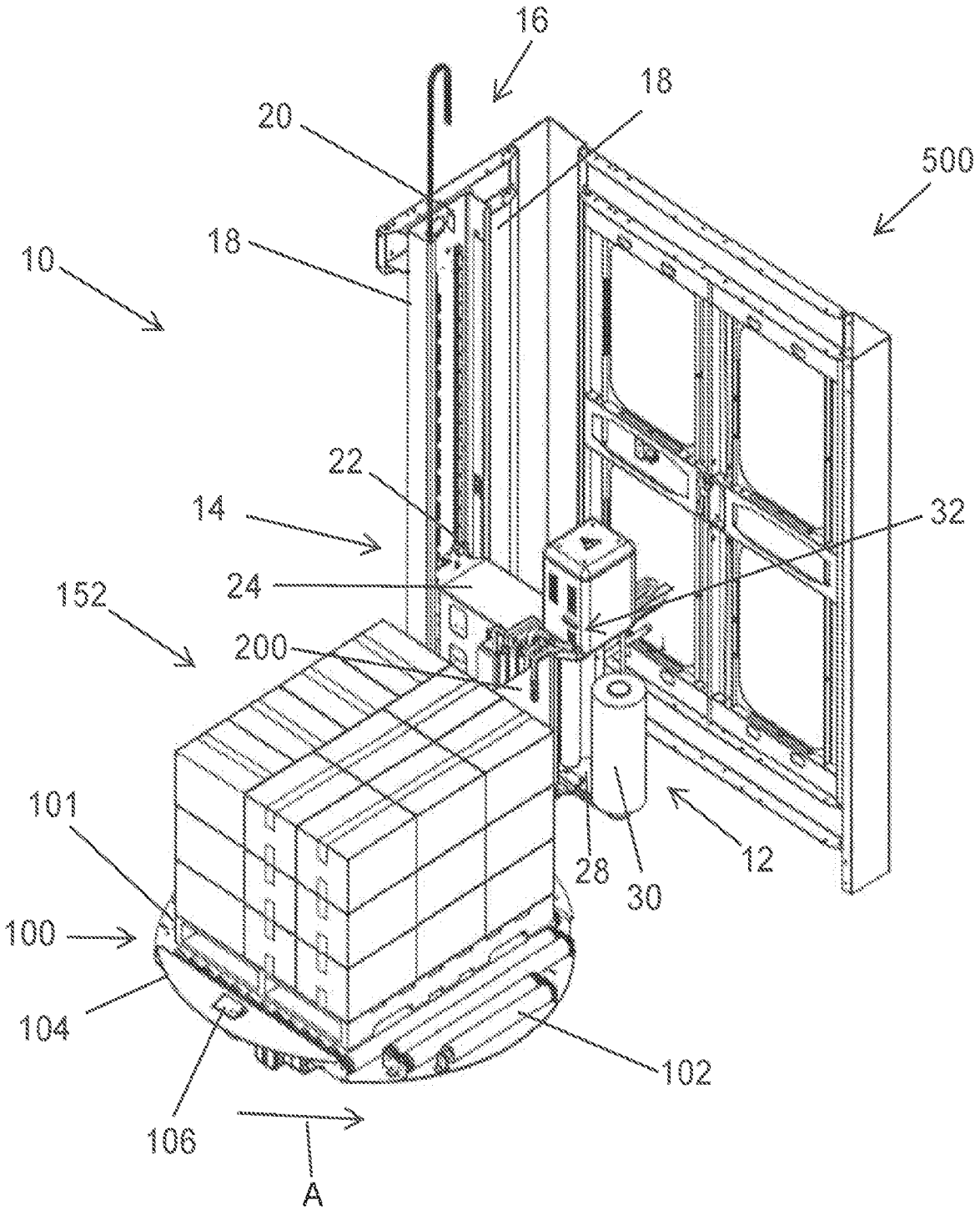
FIG. 1 is an upper perspective view of a stretch wrapping apparatus according to the present invention, including a palletized load positioned on a turntable adjacent to the stretch wrapping apparatus, and including portions of an enclosure for the apparatus.
Figure 2:
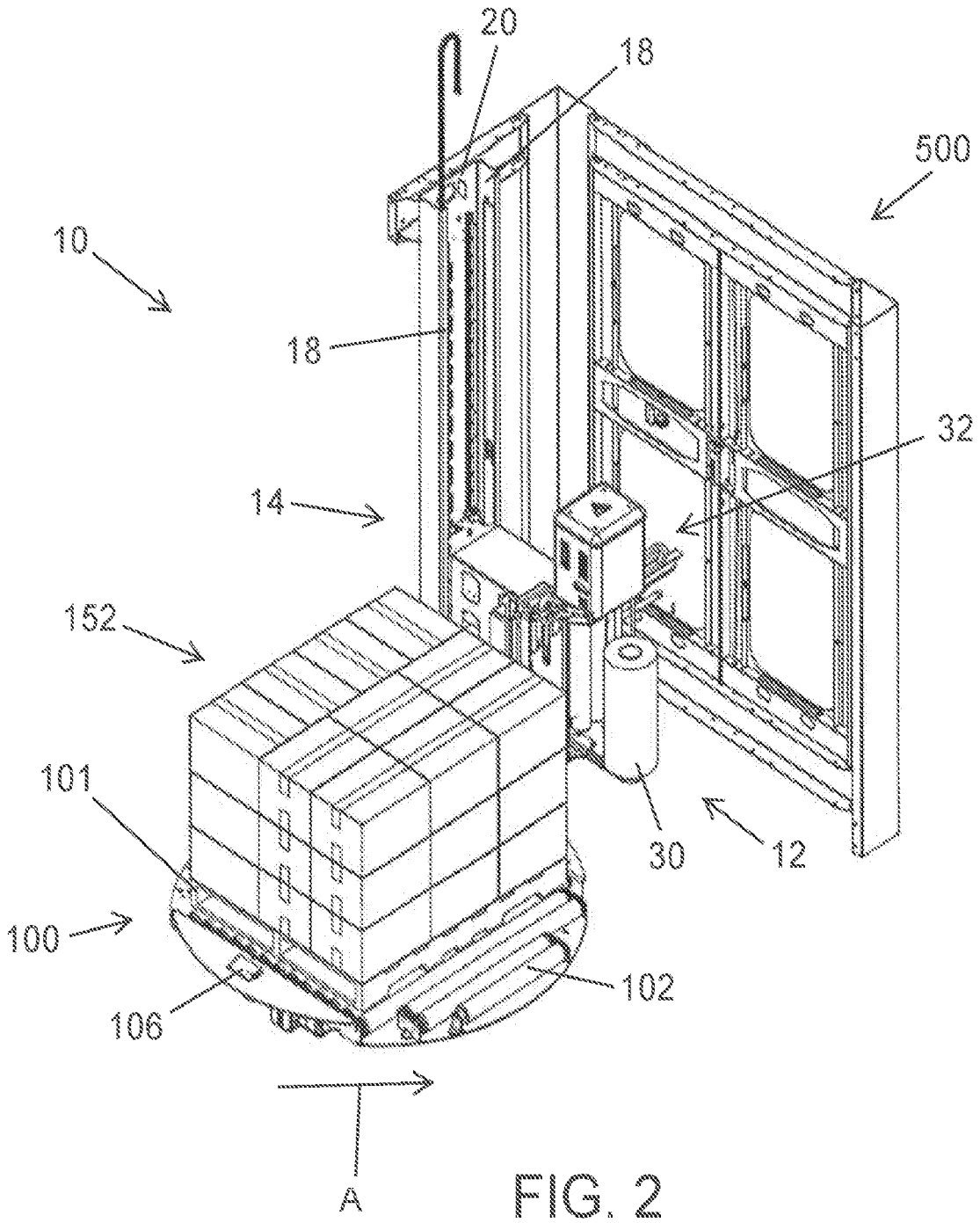
FIG. 2 is an upper perspective view of the stretch wrapping apparatus as shown in FIG. 1, except that in FIG. 2 the film is illustrated as being broken or cut.

Stretch wrapping apparatus 10 generally comprises a stretch wrapping head assembly 12 that is mounted to a carriage assembly 14 that is vertically reciprocally mounted on a frame 16. A turntable 100 is located immediately adjacent stretch wrapping head assembly 12. As seen in FIG. 1, a pallet 101 is operatively positioned on turntable 100 and carries a completed stack of palletized boxes 152. Frame 16 includes vertical posts 18 that are interconnected with a top rail 20. Carriage assembly 14 defines a movable carriage on which stretch wrapping head assembly 12 is mounted and includes guide rollers 22 that are received in vertical tracks formed in the posts 18 in a conventional manner. A carriage lift drive motor is mounted to the carriage assembly 14 in a motor enclosure 24 and drives vertical reciprocal movement of the carriage assembly with a conventional carriage hoist chain assembly or other appropriate lifting mechanism.

An enclosure 500, shown partially in FIG. 1, is generally desirable to isolate and protect components of apparatus 10 and for safety purposes.

Stretch wrap head assembly 12 comprises components described below, which are mounted to a horizontal support member 28 that is mounted to carriage assembly 14 so that vertical movement of the carriage assembly directly moves the stretch wrap head assembly. A roll 30 of stretch wrap film 200 is mounted on a mandrel (not shown) operatively adjacent to the head assembly 12 with the longitudinal axis of the roll vertically oriented relative to the ground plane and such that the film 200 may be fed into the head assembly as described below. A film pre-stretch assembly shown generally at 32 is adjacent the roll 30 and includes a pre-stretch drive motor contained in a cowling or enclosure 34; the drive motor is operatively connected to and drives pair of vertically oriented pre-stretch drive rollers 36. A film guide roller 38 is located between the drive rollers 36. In some instances, and in some installations more than one pair of pre-stretch rollers 36 may be used and additional guide rollers 38 may be utilized.

The driven rollers 36 define the active film payout mechanism for dispensing the film 200. Film 200 is fed over the film guide roller 38 and then through driven rollers 36. When pre-stretch film dispensing occurs, the drive rollers rotate at different speeds which pre-stretches film between the adjacent rollers. Non pre-stretch dispensers generally use one driven roller or using relative motion between the load and dispenser, film is pulled directly from the roll that usually has some type of friction clutch to create film tension.

Directly downstream of the film drive rollers 36 are a pair of oppositely mounted and vertically oriented film exit guide rollers 202 and 204. The guide rollers 202 and 204 are mounted to upper and lower mounting brackets, 206 and 208. As detailed below, the film 200 is fed from the drive rollers 36 through the film exit guide rollers 202 and 204. A tangent line between the film guide exit rollers 202 and 204 defines the film exit point for film delivered from the pre-stretch assembly 32 toward the load. Pressurized air is delivered via one or more air tubes to feed compressed air to two vertically oriented and parallel film training air jet tubes 44 and 46. The air jet tubes 44 and 46 include plural air jets 48, which are openings through which pressurized air is directed onto film 200, as detailed below, as the film is blown toward the boxes 152 on pallet 101. The air jet tubes 44 and 46 are positioned adjacent and one on each side of the film exit guide rollers 202 and 204 such that film 200 being fed through and traveling through the exit guide rollers is fed between the two air jet tubes and the air expelled from the air jets 48 is directed onto the film. Plant air is the preferred source of air for delivery to the air jet tubes 44 and 46 because it is more economical than, for example, an air blower motor, and plant air is available instantaneously while pressurized air from a blower motor typically requires spool up time. That said, in some situations an air blower motor may be utilized successfully, and could be mounted, for example, in enclosure 42.

Figure 4:
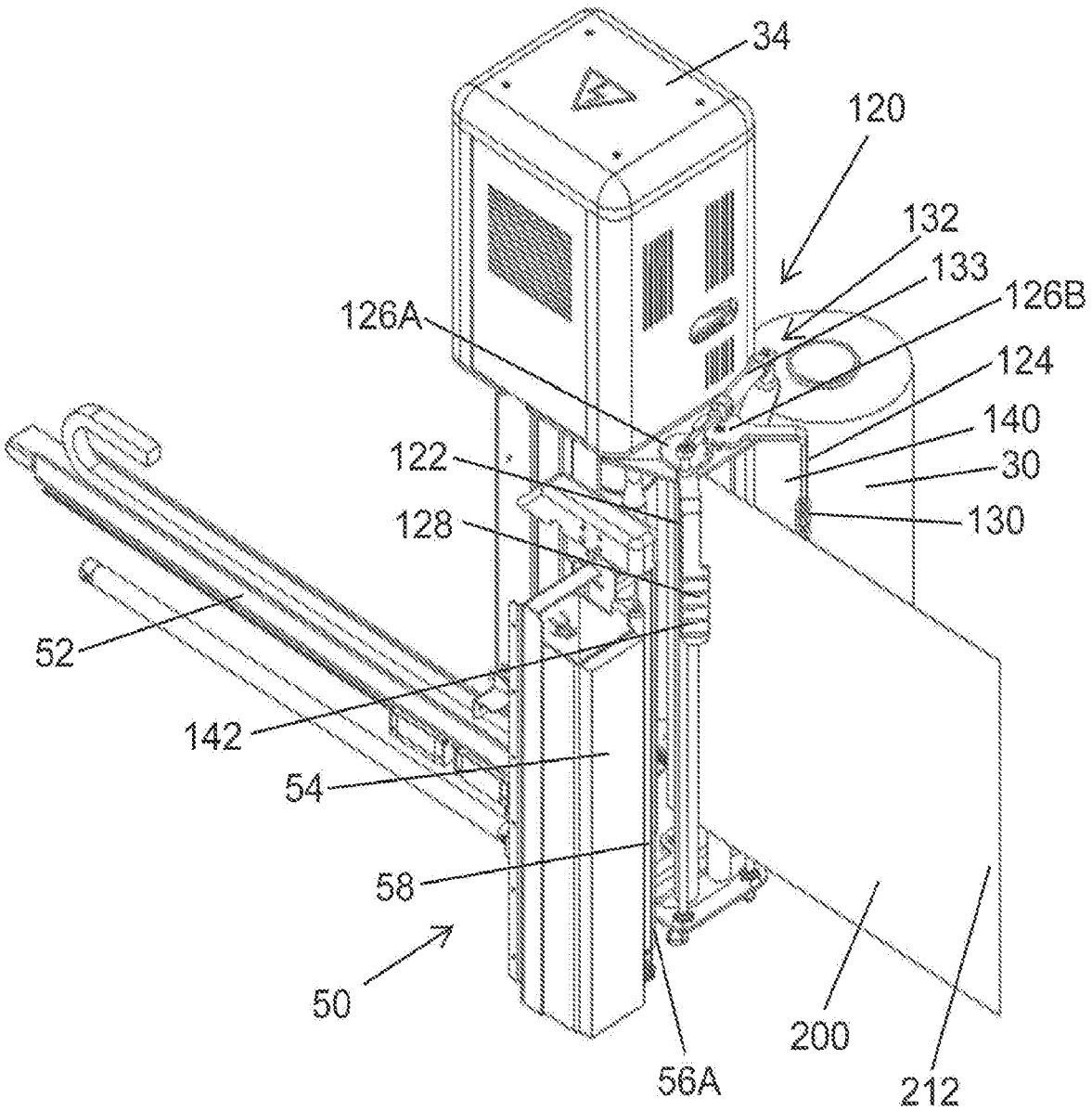
FIG. 4 is an upper perspective view of the stretch wrapping head of the present invention shown in isolation, with the clamps in the unclamped (or open) position and illustrating the film tail as it would be dispensed toward a palletized load.
Figure 5:
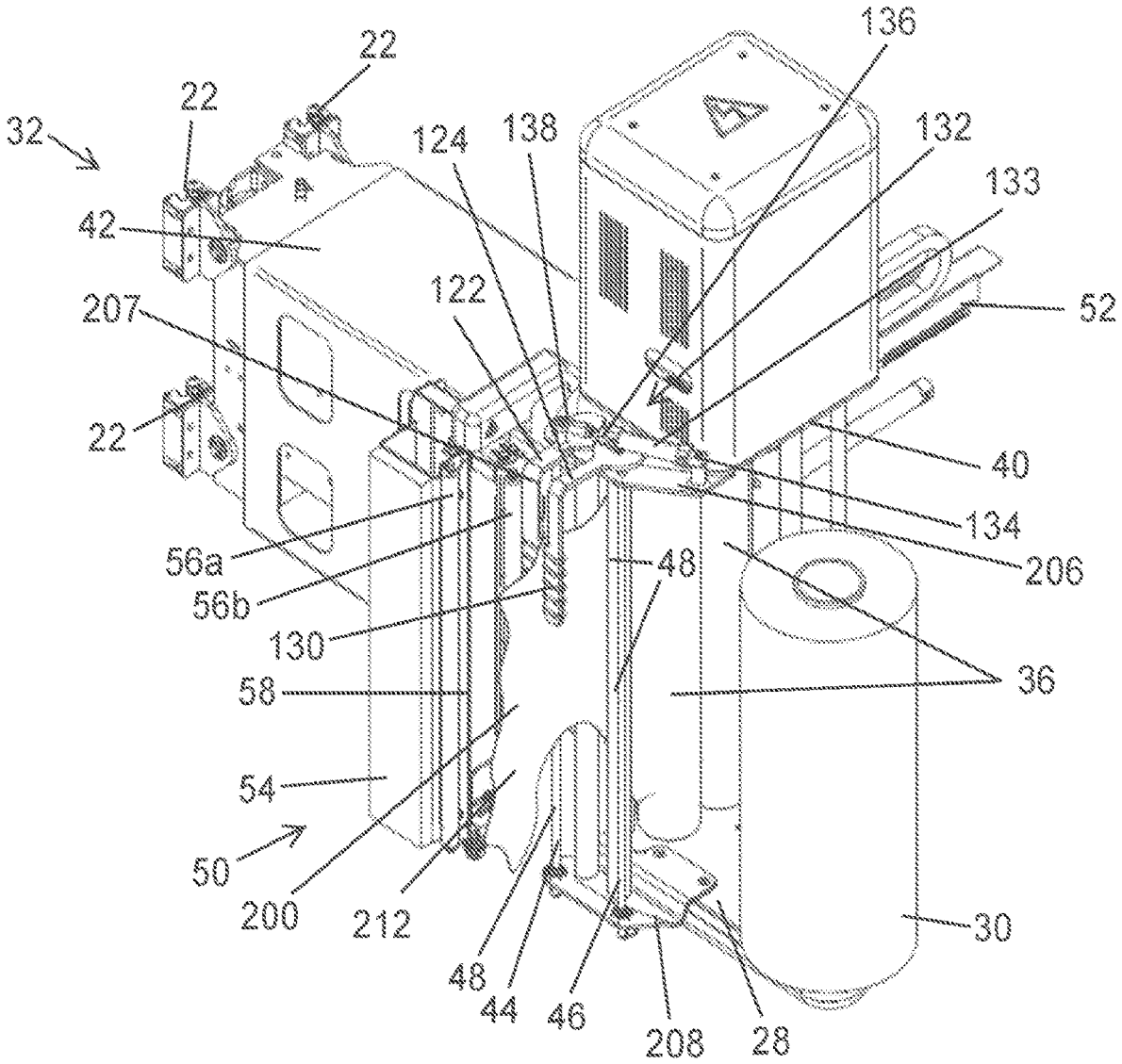
FIG. 5 is an upper perspective view of the stretch wrapping head of FIG. 4, again shown in isolation, with the clamps in the clamped (or closed) position and illustrating the film tail as it would when the film has been cut or broken.
Figure 6:
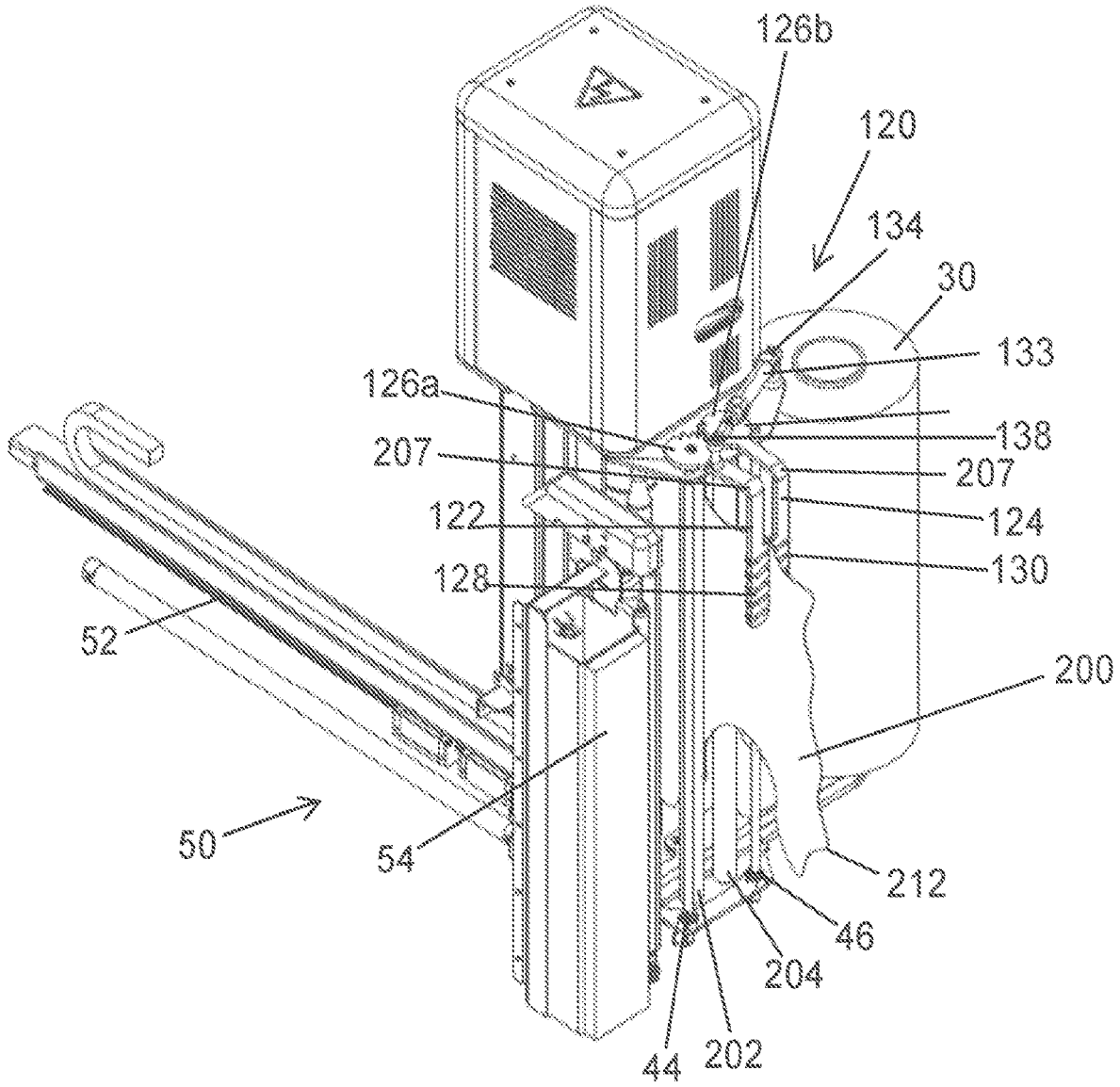
FIG. 6 is an upper perspective view of the stretch wrapping head of FIG. 5 from another angle, with the clamps in the clamped (or closed) position and illustrating the film tail as it would when the film has been cut or broken.

A clamp assembly 120 is mounted to upper bracket 206 as best illustrated in FIGS. 4 and 5. Notably, the clamp assembly 120 is fixedly mounted to the film pre-stretch assembly 32 and such that the clamps (described below) are in a fixed position relative to the point at which film exits the pre-stretch assembly. The clamp assembly 120 is defined by two L-shaped clamp arms 122 and 124, each of which has a geared base portion 126 (126*a* and 126*b* in FIGS. 4 and 5) that is pivotally mounted to the bracket 206, a 90 degree bend 207 and a downwardly depending clamp portion 128 and 130, respectively. The L-shaped clamp arms 122 and 124 are mounted on bracket 206 so that the gears of base portion 126*a* of clamp arm 122 mesh with the gears of base portion 126*b* of clamp arm 124. A drive cylinder 132 has a cylinder barrel 133 having its proximate end 134 mounted to bracket 206 and a reciprocating, driven piston 136 that translates within the cylinder barrel and has its distal end 138 pivotally mounted to L-shaped clamp arm 122 between the 90 degree bend 207 and the pivotal attachment point of the base portion 126*a* to bracket 206. Drive cylinder 132 may be of any appropriate type, such as pneumatic, hydraulic, electric, or other. It will be understood that operation of the drive cylinder 132 in a first direction causes the driven piston 136 to extend out of the cylinder barrel 133, thereby causing rotation of clamp 122 about the pivotal attachment of the clamp to bracket 206. Simultaneously, because the geared base portion 126*a* of clamp arm 122 is meshed with geared base portion 126*b* of clamp arm 124, as clamp 122 is rotated by extension of cylinder barrel 133, clamp arm 124 is rotated in the opposite rotational direction about its pivotal attachment of the clamp to bracket 206. Thus, when piston 133 is in the extended position shown in FIG. 4, the clamp arms 122 and 124 are in the open position such that a gap 140 is defined between the clamp portions 128 and 130 and so that film 200 may be delivered through the gap to a palletized load.

Operation of drive cylinder 132 in the opposite directly, namely, to retract driven piston 133 into cylinder barrel causes the two clamp arms 122 and 124 to rotate the opposite directions and to thereby close gap 140 and to thus securely clamp or grip the film 200 between clamp arms as shown in FIG. 5. This is the closed position of the clamp arms. Optional grippers such as elastic bands 142 may be included on clamp portions 128 and 130 to provide a more secure grip between the clamps and the film.

Figure 7:
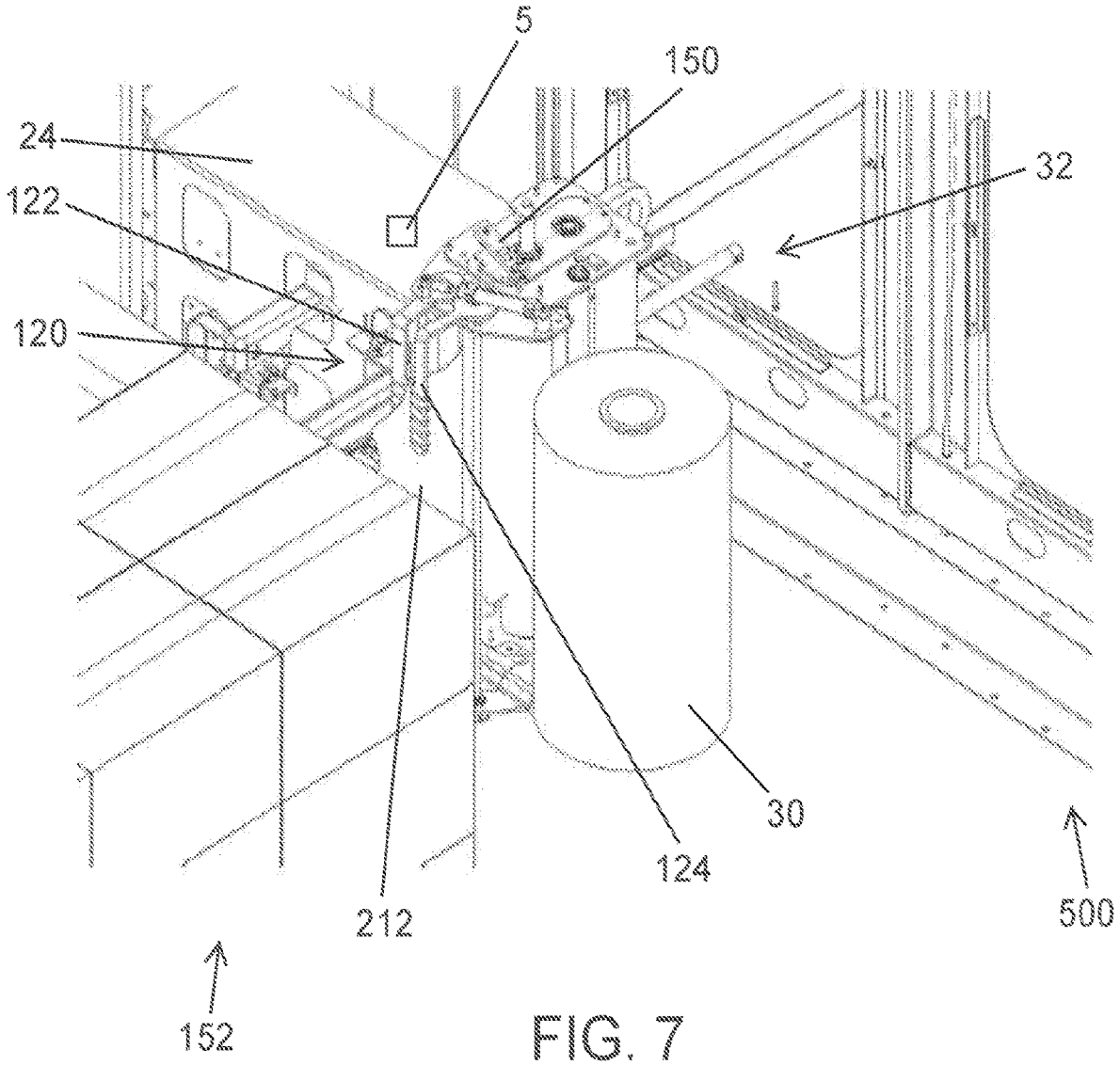
FIG. 7 is an upper perspective view of the stretch wrapping head according to the invention, positioned adjacent to a palletized load, and in which some of the enclosure cowling has been removed from the stretch wrapping head to illustrate components.
Figure 8:
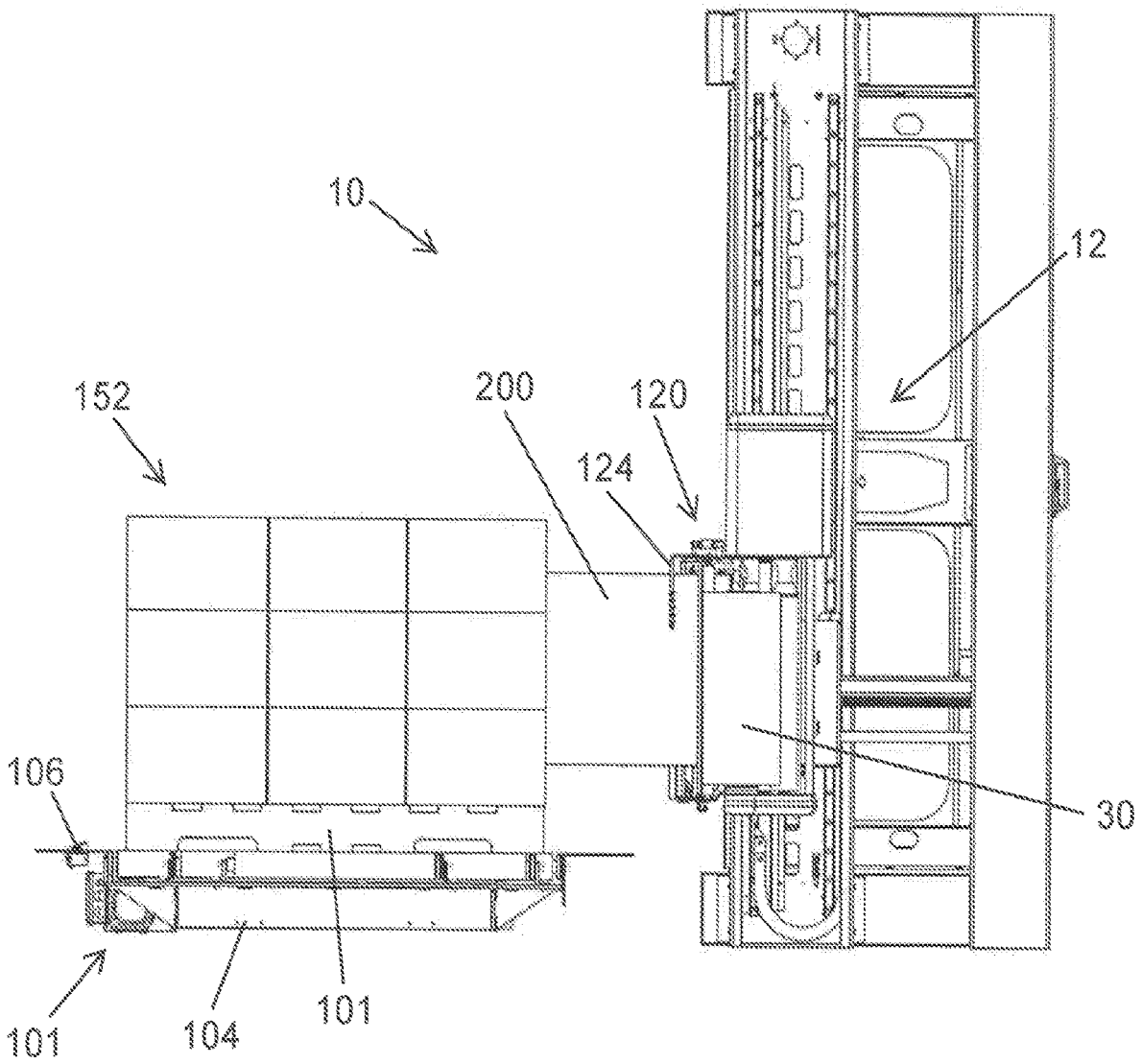
FIG. 8 is a side elevation view of the stretch wrapping apparatus as shown in FIG. 1, showing the film attached to the palletized load during the wrapping operation.
Figure 9:
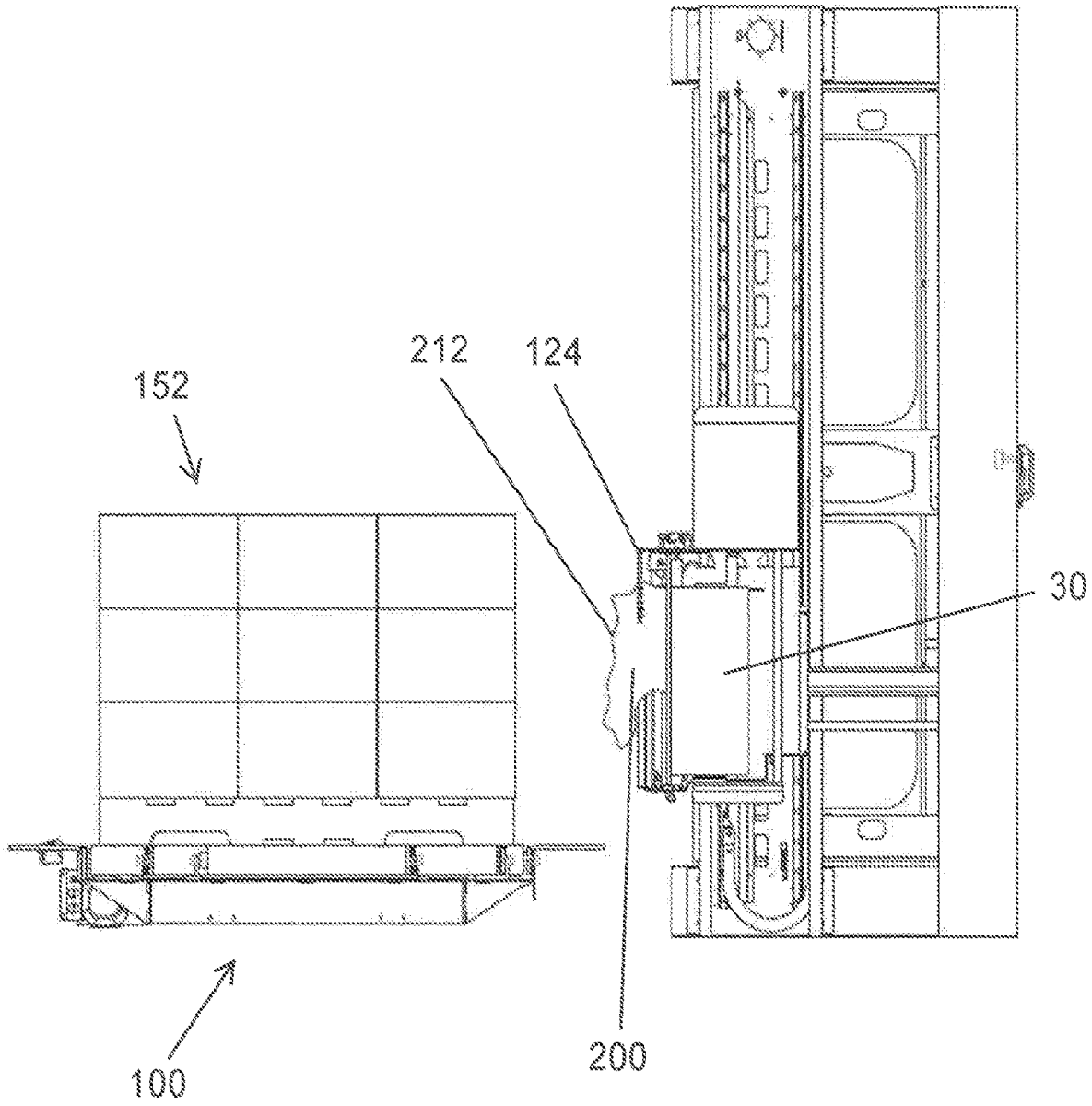
FIG. 9 is a side elevation view of the stretch wrapping apparatus as shown in FIG. 7, showing the film in a broken or cut condition.

With reference now to FIG. 7, the stretch wrap head assembly 12 is shown with the cowling 34 removed so that internal components are shown. Notably, a load cell 150 is mounted to the head assembly 12 and is operable to continuously monitor the tension in film 200 as a load is being wrapped. Load cell 150, along with other controllable components of the stretch wrapping apparatus 10 are under the control of programmable controller 5, which is shown schematically in FIG. 7. Load cell 150 does not control or alter film tension, but only measures and monitors tension, providing input to controller 5, which adjusts the rate at which film is dispensed based on the film tension data from load cell 150.

Stretch wrap head assembly 12 further comprises a film cut assembly 50 that comprises a linearly extensible and retractable arm 52 that has on its distal end, that is, the end that may be extended toward a palletized load, a pressure pad 54, a pair of vertical rolls 56*a* and 56*b*, and a film cut hot wire 58 strung between the rolls 56*a* and 56*b* such that the hot wire is coincident with the outer tangent between the two rolls 56. Considering the direction of load rotation on turntable 100 (i.e., arrow A, FIG. 1), roll 56*a* is considered to be the downstream roll and roll 56*b* is thus the upstream roll. A film cut assembly actuating air cylinder (not shown), which is under the control of programmable controller 5, functions to drive arm 52 from its retracted position (shown, for example, in FIG. 4) to an extended position, which is shown in FIG. 7. Operation of the film cut assembly 50 is detailed below.

With returning reference to FIG. 1, turntable 100 comprises plural driven rollers 102 mounted on a rotatable base 104. An encoder is shown schematically at 106 and is mounted to turntable 100. Turntable 100 is rotated in the direction of arrow A in FIG. 1 with a turntable drive motor, which is not shown; encoder 106 may be mounted to the drive motor instead of directly to the turntable. Turntable rotation speed and position is known based on encoder feedback. Other types of position indicator(s) may be substituted for encoder 106.

As noted previously, the stretch wrap apparatus 10 and all components, and turntable 100, are under the control of a programmable controller 5. Operation of apparatus 10 will now be described in detail.

Certain operational parameters and criteria are programmed into controller 5 for each load, i.e., each pallet of boxes 152 that is or will be stretch wrapped by apparatus 10. Those operational parameters and criteria include a. The film dispensing point—that is, the film exit point as defined above—remains at a known distance from the center point of turntable 100;
b. The load being wrapped is positioned centered on the turntable;
c. The finished load size dimensions are known from existing data available from the palletizer controller that is building the load;
d. Once the turntable 100 begins to rotate the rotation speed is known by data from encoder 106 and corner positions of the load begin to change relative to the dispensing point. Controller 105 initiates film dispensation toward the load, the clamp arms 122 and 124 of clamp assembly 120 are opened, and the pressurized air is blown through the air jets 48 and onto the free end of the film;
e. As film attaches to the load the film tension is continuously measured and monitored by load cell 150 and film tension data are transmitted to the programmable controller 5;
f. As turntable rotation occurs, film is dispensed at a rate—a payout rate—determined by the film tension data provided by load cell 150 to controller 5 and such that payout of film that is consistent with and appropriate for the measured film tension. Thus, the demand rate of film payout is determined by and reactive to the film tension;
g. Film dispensing rates can be varied with offsets or other factors to slightly increase or decrease payout relative to tension values;
h. Compensating for helix as the carriage assembly 14 moves vertically relative to the load by tracking the change in film head height relative to the height the film was at when the film engaged the load;
i. Should load size characteristics not be known from the palletizer or other systems, sensors can be used to determine load size and position on the turntable or operator input at an operator interface station can be used.

With the foregoing parameters being set, the stretch wrapping procedure begins with a pallet 101 having a completed stack of boxes 152 positioned thereupon is moved onto the center of turntable 100 with the assistance of driven rollers 102. The load dimensions are known by controller 5 as indicated previously.

Figure 3:
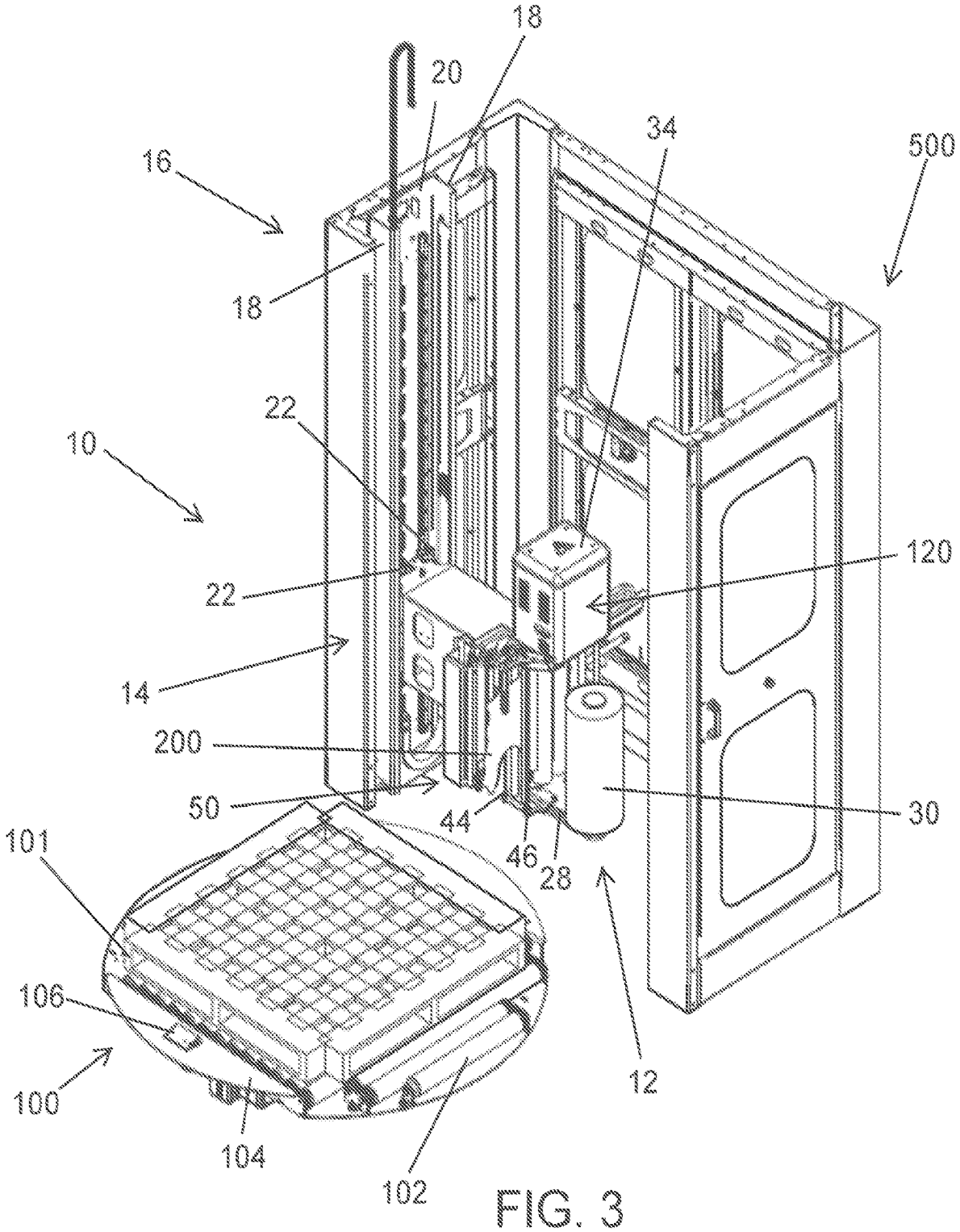
FIG. 3 is an upper perspective view showing a stretch wrapping apparatus according to the present invention in which the load has been removed from the turntable and the clamps are in the clamped position, gripping the film.

The free end 212 of film 200 is retained by clamp assembly 120 as seen in FIG. 3. That is, the clamp arms 122 and 124 are in their engaged, clamped position with the film captured therebetween. This is the normal condition at all times when wrapping is not being done. The air blow is preferably off while the clamps are engaged and holding the free end 212 of the film so there is no air being blown on the film. The arm 52 of the film cut assembly 50 is in the retracted position. Turntable rotation is initiated and with the turntable rotating and the vertical position of the stretch wrap head 12 set to the desired position, air flow through the air jets 48 is initiated for a short period of time so that the free end 212 of the film is controlled. The clamp arms 122 and 124 are then moved to their open position to disengage the clamping of the film and film blow is on (that is, pressurized air is being blown onto the film tail). Film dispensing is initiated shortly after the clamp arms 122 and 124 are opened, or alternately, concurrently with opening of the clamps, and film is dispensed through the pre-stretch drive rollers 36 and through the dispensing point between the air tubes 46 and 48. Prior to attachment of the film to the load, and with the clamp arms 122 and 124 in the open position the free or loose end 212—i.e., the "tail" 212 of the film 200 is unsupported other than the "support" provided by the pressurized air that is being trained on the film. The tail of the film is thus blown toward the load. Air is blown onto the advancing film until the film has attached to the load but once attachment has occurred the flow of pressurized air may be discontinued for the remainder of a wrapping cycle.

During pre-attachment, the film is dispensed by the pre-stretch rollers 36 at the rate at which the film would be dispensed if the film were attached to the load. As the film is paid out by the pre-stretch drive rollers 36 the tail 212 of the film makes contact with a surface of the load that is rotating on the turntable—as noted below, the surface that the film contacts may be a side surface, an upper corner surface, or some other location. Contact between the film and the load is sustained by the continuous flow of air being blown onto the film and the film attaches to the load after it makes contact, either directly or by virtue of sustained contact between the film and the load. In some instances, depending upon a variety of factors such as environmental factors, the nature of the load, etc., the load may rotate through a complete rotation or more before the film attaches to the load. However, the film will positively attach given the sustained and continuous air stream from the blower that pushes the film against an outer surface of the load, such that the film makes sustained contact with the load as it rotates. Once the film attaches to the load, film tension data is measured by load cell 150 and transmitted to controller 5. As indicated above, the rate at which film is dispensed from stretch wrapping head assembly 12 is controlled by controller 5 and is reactive to the film tension data from load cell 150, and the flow of pressurized air is off.

The vertical position of the carriage assembly may be initially located near the upper limit of the load so that the tail 212 of the film 200 attaches near the top or on one of the upper corners of the boxes 152. The film is then wrapped in a downward helix; the carriage assembly 14 is moved downward as the turntable rotates. Equally well, the tail of the film 200 may be blown onto a side of the load where it catches quickly in most instances to begin the wrapping operation; the carriage assembly 14 is repositioned vertically as required to wrap the load. Regardless of the position at which the film tail contacts the load, i.e., on a side surface, an upper corner surface, or another location, the film attaches because it is continuously blown into contact with an outer surface of the load by the air from the blower. This may be contrasted with the prior art, where film was blown toward a stationary load and where the film was secured to the load by virtue of capturing the film between the cases and the pallet, or between layers of the cases. In other words, prior uses of air to blow film toward a load required the weight of the load to secure the film between one inner surface (e.g., the pallet or an upper surface of an intermediate layer of cases) and another inner surface (e.g., the lower surface of layer of cases).

Wrapping continues until the load has been completely wrapped. Once the load is completely wrapped the film 200 is cut by operation of film cut assembly 50. The cut arm assembly 50 is shown in the retracted or home position in FIG. 1. This is the position that is used during wrapping operations. When a load is completely wrapped, the rotation of turntable 100 is stopped with the load in the position shown in FIG. 1. Blower operation is off and the film is clamped by clamp arms 122 and 124. Controller 5 initiates extension of arm 52 to the extended position shown in FIGS. 7 and 10. In this position the pressure pad 54 contacts the side of the palletized and wrapped load the downstream roller **56*a* is in contact with the film 200; upstream roller 56*b* may or may not be in contact with the load. After the load is wrapped, the pressure applied to the film by pressure pad 54** acts as a method of pressing the film against the load to secure the film.

Figure 10:
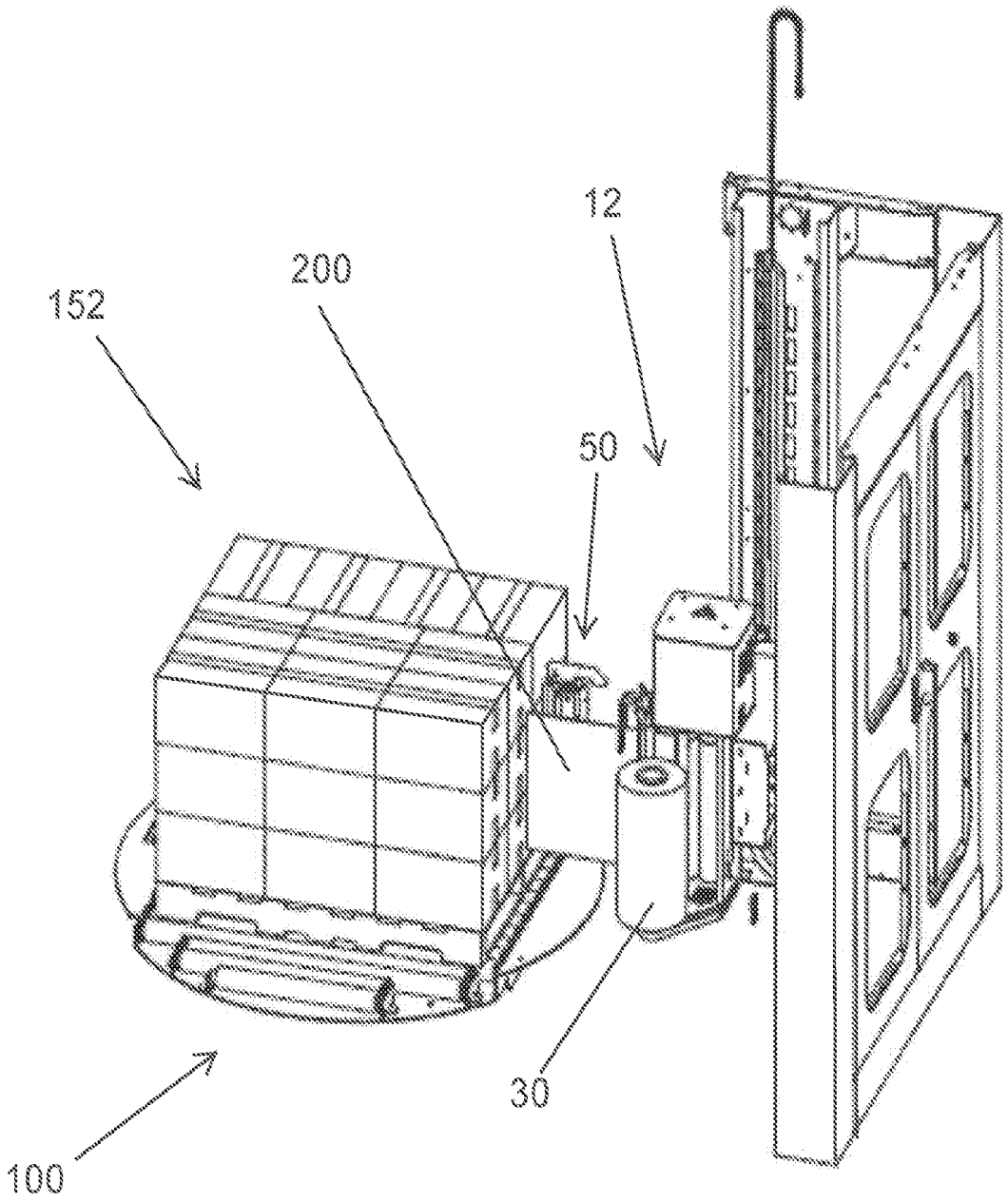
FIG. 10 is an upper isometric view of a stretch wrapping apparatus according to the present invention, including a palletized load positioned on a turntable adjacent to the stretch wrapping apparatus, in which the film clamps are shown in the clamped position, the film is unbroken or uncut, and the film cut assembly is shown in the extended position.

When the pad 54 makes contact with the load as shown in FIG. 10, the hot cut wire 58 is energized, heating the wire and thereby cutting the film while the retractable arm 52 is in its extended position. At this point the film 200 is deflected across the upstream and downstream rollers **56*a* and 56*b*; the close proximity of the hot wire 66 to the film, even if no actual contact is made between the film and the wire, causes the film to be cut. Moreover, avoiding direct contact between the wire and the film can be advantageous to avoid residual melted film from building up on the wire. The pad 54** contacts the load and thus presses the cut edge of the film onto the load and this avoids a loose film end.

Once the film 200 has been cut the arm 52 is retracted to its home position and the wrapped load is transported off the turntable.

Operation of the stretch wrap apparatus 10 in the case of a film break, anticipated or predicted film break, and other operational conditions are now described in detail. The term "film break event" as used herein refers to conditions that result in a break of the film. As detailed below, a film break event may be an unanticipated break of the film, or a film break event may arise from conditions that result in an intentionally-caused break of the film, as in a predicted film break, and also a film cut that is intentional, such as occurs at the end of a wrapping cycle.

At all times during which the film 200 is attached to a palletized load and the film 200 is being dispensed toward the load, load cell 150 monitors and detects the film tension information and that information is transmitted to controller 5, which is in communication with the load cell 150. Load cell 150 also monitors and detects film tension information when the film is not attached to a load, in which case the load tension measured may be a zero value. Controller 5 is programmed with operational specifications for film tension, referred to herein as X (i.e., film tension=X), which may be dependent upon the type of film and its specific characteristics (such as type of film, film thickness, film manufacturer, etc.), but in all cases which include parameters for:

a. Nominal film tension range. This is a range of values for film tension X in which the film tension is deemed to be satisfactory so that wrapping is deemed to be proceeding as expected. The range has an upper end value Z and a lower end value Y, and the range may be expressed as [Z, Y], or $Z \geq X \geq Y$. Depending upon conditions and the type of film, the difference between the upper end value Z and X, and the difference between lower end value Y and X in the range do not need to be equivalent. Said another way, the value range between X and the upper end value Z may be greater than the value range between X and the lower end value Y, and vice versa.

b. Out of bounds film tension. There are two basic out of bounds conditions based on film tension X detected by the load cell 150, and as programmed in the controller 5.

1) if the film tension X detected by load cell 150 is greater than the upper end value Z. In this situation, film tension X is deemed to exceed the upper end value for film tension. This condition is deemed to be out of bounds because it is an accurate predictor of an imminent film break. An imminent film break may be predicted by a film tension X that is higher than the upper value limit Z because it is known that for the particular film that is being used, the film will typically break when film tension exceeds the upper value limit.

2) if the film tension X detected by load cell 150 is less than the lower end value Y. If this condition exists, then film tension X is deemed to be below the lower end value for film tension. This condition also is deemed to be out of bounds as it is a predictor of either an imminent film break or that a break has already occurred. When the detected film tension X drops to a value that is below the lower limit Y, it is known that the film has either broken, or, for instance, the resiliency of the film has been compromised such that insufficient tension is being applied to the film as it is being wrapped and this is a predictor of imminent film break. When a wrapping cycle is complete and the film has been cut, the detected film tension X is equal to zero.

As detailed below, there are a variety of operational sequences that apply to the conditions recited above as detected by the load cell 150.

a. Film Break. As indicated above, when a break in the film occurs during wrapping operations there is a danger that the newly created film tail will recoil back toward the shrink wrap head and become entangled in the equipment. The operational procedures described below are designed to control the film tail that is created by the break to prevent entanglement. When a film break occurs during the wrapping operation the value of tension X as detected by load cell 150 immediately drops to a value below the lower limit Y. When the value of tension X is below lower limit Y, the programmable controller 5 immediately causes the clamp arms 122 and 124 of clamp assembly 120 to move to the clamped position. Simultaneously, the controller stops the film feed through the shrink wrap head. The film tail is captured between the clamp arms and the palletized load continues to rotate on the turntable. A film break event of the nature just described is an unintentional film break.

With the film captured between the clamp arms and the film dispensation discontinued, the system is ready for reattachment of the film to the load in the same manner as described above with respect to the initial attachment of film to an unwrapped load. The only difference in this situation with a film break is that the vertical position of the shrink wrap head may be moved vertically, up or down, so that when film reattachment occurs the area where the break occurred on the partially-wrapped load is overwrapped with the reattached film. This ensures a secure wrap for the load and prevents any loose film tails hanging from the load. Moreover, during reattachment use of the blower may not be necessary depending on, for instance, the type of film being used.

b. Predicted or Anticipated Film Break. As described above, there are two possible conditions where controller 5 is programmed to determine that a film break is anticipated and therefore initiates corrective operations to prevent entanglement of a film tail that might occur with a break. The first is where film tension X detected by load cell 150 is greater than the upper end value Z. The second is where film tension X is less than the lower limit value Y. In both conditions the film may be intact, but the detected film tension is a predictor of an imminent break. As such, corrective action is taken to prevent an uncontrolled break and possible recoil of the film tail created by the break with entanglement of the film. When either condition occurs, and immediately upon detection of the condition, controller 5 causes the clamp arms 122 and 124 of clamp assembly 120 to move to the clamped position. Simultaneously, the controller stops the film feed through the shrink wrap head. The turntable 100 continues to rotate. If the film is still intact, with the clamps securely gripping the film and the film dispensation stopped, the film breaks between the clamps and the load. In this case, the film break is caused by the clamps gripping the film, but the break is controlled and recoil of the film tail and possible entanglement with the other components of the shrink-wrapping assembly is prevented. Film break events of the type described in this paragraph are intentional in the sense that the film is not actually broken until a predicted break or anticipated break is detected by tension measurements, and the clamps are moved into the closed position in order to cause the actual break of the film so that recoil is controlled.

c. Another type of film break event, for purposes herein, occurs at the end of a wrapping cycle when the load is completely wrapped and the film is intentionally cut by the film cut assembly 50 as described above. Like the predicted or anticipated film breaks described above, a film break event that arises from intentional cutting of the film after a wrapping cycle is complete is an intentional film break.

Reattachment of the film proceeds in the same manner as described above with respect to the reattachment of film to after a film break, with adjustment of the vertical position of the shrink wrap head so that when film reattachment occurs the area on the load where the break occurred is overwrapped with the reattached film.

Some palletizing operations provide for concurrent load building and stretch wrapping. Said another way, the load is built on the pallet and stretch wrapping occurs as the load is being built. The principles of the invention described above are equally applicable in this type of a palletizing/stretch wrapping machine configuration, For example, using the pre-stretch assembly and clamp assembly described above, film may be blown onto an empty pallet that is on the turntable prior to the first layer of boxes being deposited onto the pallet; typically, the film is captured under the boxes of the first layer. As the layer-building continues, stretch wrapping occurs simultaneously. The clamp assembly 120 provides for much greater reliability in blowing the film onto the empty pallet because the tail of the film is always controlled by clamps 122, 124, prior to blowing onto the pallet, thereby eliminating the risk of film entanglement. The same is true where the film is first blown onto a pallet that has one or more layers already built. In that case, the film is blown onto the existing layer or layers of boxes and stretch wrapping is simultaneous with palletizing. Again, film tail entanglement risk is either eliminated or greatly reduced because the clamps manage and control the film tail prior to engagement. It will be appreciated therefore that as used herein, the term "load" may refer to an empty pallet, a partially loaded pallet, or a fully loaded pallet.

In an embodiment of the invention, stretch wrap apparatus 10 may include an optional, optical film sensor 40 is positioned downstream of the film drive rollers 36. Sensor 40 detects the presence (or absence) of film and optionally, the relative condition of the film, as detailed below. Sensor 40 is attached to the stretch wrapping head assembly 12 to sense if film 200 is not exiting the pre-stretch assembly 32 because the character of the film momentarily changes. As noted, sensor 40 is an optical sensor that can detect presence and optionally the position or character of film 200. If sensor 40 detects that film is no longer exiting the pre-stretch assembly, it indicates it is likely that the film 200 on roll 30 has run out, or there is some other failure. Optionally, a different type of sensor can be used in place of sensor 40 to detect if the film is actually being dispensed through the pre-stretch rollers, or detect defects such as partial film tears or holes in the film based on optical characteristics described below. When there is, for example, a break in the film the film flutters. This causes changes in the optical characteristics "seen" by sensor 40 and this is indicative of an out of bounds situation. Further, the sensor 40 may be adapted to sense engagement of the tail of the film to the load by continuous monitoring of the integrity of the film web between the pre-stretch assembly 32 and the load. If film web integrity has been compromised, the problem is detected by sensor 40 (again, by optical characteristic changes) and action will automatically be taken via controller 5 to insure load containment by dispensing additional film in the area of the load where the film defect was encountered in order to, for example, overwrap the portion of the load where the break occurred to insure complete film wrapping of the entire load. Sensor 40 is described above as an optical sensor, but other sensor technologies exist that may be used instead, such as ultrasonics.

Those of skill in the art will readily appreciate that invention described herein and illustrated in the drawings may be modified in certain manners to create equivalent equipment without departing from the nature of the invention. For example, while the invention has been described as used with a turntable on which a palletized load is positioned, it is equally possible to create the required relative rotational motion between the load and the stretch wrapping head by keeping the load stationary and by rotating the stretch wrapping head around the stationary load. Accordingly, the term rotational axis is used herein to describe the center point for both a of these different methods of creating relative rotation between the load and the head, i.e., (a) where a stationary head used in combination with a rotating load, and (b) where a stationary load used in combination with a rotating head.

As another example, the pre-stretch assembly 32 may be modified such that the last pre-stretch roller (i.e., the most downstream roller in terms of film dispensing direction) is positioned such that film exits the roller without a downstream idler roller. This is done by canting the assembly so that film is fed directly off the last pre-stretch roller into the space between the air tubes 44, 46. Pressurized air may be supplied in numerous additional ways, for instance, a canister of pressurized air to name but one of many examples. Other modifications will be apparent to those of skill in the art.

The present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. Apparatus for preventing film entanglement in a stretch wrapping machine for wrapping a load, comprising:

a vertically movable dispensing head having at least one pair of pre-stretch rollers adapted for dispensing film;

a first drive mechanism for driving the at least one pair of pre-stretch rollers to dispense film;

a source of pressured air blowing through air jets trained on the film after it is dispensed from the at least one pair of pre-stretch rollers, thereby blowing the film toward the load;

a second drive mechanism adapted to provide relative rotation between the load and the dispensing head;

a film clamp mounted to the dispensing head between the dispensing head and the load, wherein the film clamp is adapted to grip the film if a film break event occurs; and a film tension device for continually measuring film tension to generate film tension values and transmitting film tension values to a controller, wherein an acceptable tension value range is stored in the controller and the film break event is defined as a film tension value that is above or below the acceptable tension value range, and wherein the film clamp grips the film prior to the film breaking.

2. The apparatus according to claim 1 wherein when a film break event occurs the controller stops dispensation of film concurrently with causing the film clamp to grip the film.

3. The apparatus according to claim 1 in which the film has a free end subsequent to a film break and wherein the free end of the film is prevented from recoiling and becoming entangled after the film clamp grips the film.

4. The apparatus according to claim 1 in which film is dispensed at a rate that is in response to the film tension values.

5. A method for preventing film entanglement in a stretch wrapping machine for wrapping a load comprising the steps of:

a) providing relative rotation between a film delivery head and a load;

b) mounting a film clamp in a fixed position on the film delivery head;

c) dispensing film from the film delivery head and attaching the film to the load;

d) measuring tension in the film;

e) if the measured tension is above an upper limit value or below a lower limit value, closing the film clamp to grip the film and concurrently stopping dispensation of the film, wherein closing the film clamp to grip the film causes the film to break.

6. The method according to claim 5 including at least intermittently blowing air toward the film during relative rotation.

7. The method according to claim 6 including the step of closing the film clamp to grip the film before a film break has occurred.

8. The method according to claim 5 in which relative rotation is not stopped and including, subsequent to step e), reattaching the film to the load by:

a) blowing air toward the film;

b) opening the film clamp and concurrently resuming dispensation of the film from the film delivery head.

9. The method according to claim 5, wherein the film is dispensed at a rate that is determined by the measured film tension.

10. Apparatus for preventing film entanglement in a stretch wrapping machine for wrapping a load, comprising:

a dispensing head adapted for dispensing film;

a film gripper mounted to the dispensing head and located between the dispensing head and the load, the film gripper movable between a film gripping position and a film non-gripping position;

a controller in communication with a film tension measuring device that is adapted to measure film tension so that film tension values from the film tension measuring device are transmitted to the controller, wherein the controller is programmed with an acceptable film tension value range having upper and lower limits;

a drive mechanism for dispensing film from the dispensing head at a rate that is determined by the film tension values;

wherein if a film tension value is outside of the acceptable film tension value range the film gripper moves into the film gripping position, and wherein the film break event occurs prior to a film break.

11. The apparatus according to claim 10 including a source of pressured air at least intermittently blowing through air jets trained on the film after it is dispensed from the dispensing head.

12. The apparatus according to claim 11 in which a film break event is defined as a film tension value outside of the acceptable film tension value ranges.

13. Apparatus for preventing film entanglement in a stretch wrapping machine for wrapping a load, comprising:

a vertically movable dispensing head having at least one pair of pre-stretch rollers adapted for dispensing film;

a first drive mechanism for driving the at least one pair of pre-stretch rollers to dispense film;

a source of pressured air blowing through air jets trained on the film after it is dispensed from the at least one pair of pre-stretch rollers, thereby blowing the film toward the load;

a second drive mechanism adapted to provide relative rotation between the load and the dispensing head;

a film clamp mounted to the dispensing head between the dispensing head and the load, wherein the film clamp is adapted to grip the film if a film break event occurs; and a film tension device for continually measuring film tension to generate film tension values and transmitting film tension values to a controller, wherein an acceptable tension value range is stored in the controller and the film break event is defined as a film tension value that is above or below the acceptable tension value range, and wherein the film break is caused by the film clamp gripping the film.

14. The apparatus according to claim 13 wherein when a film break event occurs the controller stops dispensation of film concurrently with causing the film clamp to grip the film.

15. The apparatus according to claim 13 in which the film has a free end subsequent to a film break and wherein the free end of the film is prevented from recoiling and becoming entangled after the film clamp grips the film.

16. The apparatus according to claim 13 in which film is dispensed at a rate that is in response to the film tension values.

* * * * *